US008505736B1

(12) United States Patent
Friel et al.

(10) Patent No.: US 8,505,736 B1
(45) Date of Patent: Aug. 13, 2013

(54) BIODEGRADABLE FLOAT AID FOR MINING BENEFICIATION

(75) Inventors: Thomas Crane Friel, Saint Johns, FL (US); Debbie Tulkoff Petree, Saint Johns, FL (US)

(73) Assignee: Bastech, LLC, Jacksonville, FL (US)

( * ) Notice: Subject to any disclaimer, the term of this patent is extended or adjusted under 35 U.S.C. 154(b) by 0 days.

(21) Appl. No.: 13/288,342

(22) Filed: Nov. 3, 2011

Related U.S. Application Data

(60) Provisional application No. 61/410,686, filed on Nov. 5, 2010.

(51) Int. Cl.
*B03D 1/008* (2006.01)
*B03D 1/02* (2006.01)

(52) U.S. Cl.
USPC ..... 209/166

(58) Field of Classification Search
USPC ..... 209/166
See application file for complete search history.

(56) References Cited

U.S. PATENT DOCUMENTS

| | | | | | |
|---|---|---|---|---|---|
| 2,312,466 | A | * | 3/1943 | Erickson et al. | 209/166 |
| 3,909,399 | A | * | 9/1975 | Petrovich | 209/166 |
| 4,233,150 | A | * | 11/1980 | Wang et al. | 209/166 |
| 4,511,463 | A | * | 4/1985 | Alexander et al. | 209/166 |
| 4,589,980 | A | * | 5/1986 | Keys | 209/166 |
| 4,744,891 | A | * | 5/1988 | Selvarajan et al. | 209/166 |
| 6,871,743 | B2 | | 3/2005 | Yoon | |
| 6,994,786 | B2 | | 2/2006 | Cameron et al. | |

* cited by examiner

*Primary Examiner* — Thomas M Lithgow
(74) *Attorney, Agent, or Firm* — Smith, Gambrell & Russell, LLP

(57) ABSTRACT

A biodegradable floatation aid for use in the froth floatation process for ore beneficiation has been developed to replace the current petroleum based hydrocarbons. The product described is an ester of C-8 through C-20 alcohols and C-2 through C-12 diols or triols, reacted with C-12 through C-22 carboxylic acids or C-2 through C-36 dicarboxylic acids.

7 Claims, No Drawings

BIODEGRADABLE FLOAT AID FOR MINING BENEFICIATION

BACKGROUND OF THE INVENTION

1. Technical Field

The present invention relates to the use of esters of long chain alcohols and long chain fatty acids as a floatation aid in conjunction with fatty acids in the froth floatation process for the benefaction of ores. This invention also relates to the process for ore beneficiation by floatation. More specifically, this invention relates to the replacement of petroleum hydrocarbons, used in the froth floatation step, with esters that are readily or inherently biodegradable.

2. Prior Art

Froth floatation has been widely used over several decades to remove clays and sand from calcium phosphate ores. This process is capable of treating relatively low grades of ore into concentrated fractions suitable for further processing. Typically, the ore is slurried to make an aqueous dispersion. The aqueous slurry is then conditioned by agitating the slurry in the presence of various chemicals. The treated slurry is pumped into a floatation cell which introduces dispersed air in the form of fine bubbles. The chemicals enhance the selectivity of the fine air bubbles to adhere to the ore's surface to form a froth highly concentrated with the desired ore and is removed by mechanical means. The most common process employed by the phosphate industry is the Crago process invented in the 1940's. It utilizes three steps to enrich the ore: anionic floatation, scrubbing, and cationic floatation.

There are a tremendous number of articles and patents which address the anionic floatation reagents. The following is a sample of some of those inventions.

U.S. Pat. No. 6,994,786 B2 discloses a method of phosphate beneficiation which employs methyl and ethyl fatty acid esters that are biodegradable. Although the data presented appears to indicate that the methyl and ethyl esters can replace fuel oil, it appears that the alcohol chain length is too small for efficient adhesion.

U.S. Pat. No. 6,871,743 B2 discloses a method of phosphate beneficiation with increased floatation rate by enhancing the hydrophobicity of the particles so they can be more readily collected by the air bubbles. This patent reinforces the notion that the methyl and ethyl esters are not hydrophobic enough for a desired level of floatation.

Accordingly, there is always a need for improved froth floatation processes for the benefaction of ores. It is to these needs, among others, that this invention is directed.

BRIEF SUMMARY OF THE INVENTION

Briefly, the invention is a biodegradable floatation aid for use in the froth floatation process for ore beneficiation. The invention has been developed to replace the current petroleum based hydrocarbons. The product disclosed is an ester of C-8 through C-20 alcohols and C-2 through C-12 diols or triols, reacted with C-12 through C-22 carboxylic acids or C-2 through C-36 dicarboxylic acids.

The above features and other features and advantages of this invention will become apparent from the following description of selected preferred embodiments.

DETAILED DESCRIPTION OF PREFERRED EMBODIMENTS

The present invention is a biodegradable floatation aid for use in the froth floatation process for ore beneficiation. The product is an ester of C-8 through C-20 alcohols and C-2 through C-12 diols or triols, reacted with C-12 through C-22 carboxylic acids or C-2 through C-36 dicarboxylic acids.

Test Procedure

The novel biodegradable float aids were tested in both laboratory and full-scale floatation tests. In the laboratory testing several different phosphate ores were tested. Useful laboratory floatation methods are well established and are known to those of ordinary skill in the art. The method generally comprises conditioning the ore at specific solids, typically 68% to 76%, and preferably 72%, adding a fatty acid based floatation agent, adding a floatation aid or oil, adjusting the pH to 8.0-10.0 (with the preferred pH being dependent on the source of alkalinity), and floating for 1-2 minutes in a Denver D-12 6-liter cell. The concentrate and tails are collected, dried, weighed, and analyzed for phosphorous content and expressed as $P_2O_5$. Percent phosphorous recovery is then calculated.

Synthesis Procedure

This invention is characterized by reacting the following components at a temperature of 100° C. to 200° C., and preferably of or approximately 150° C., with or without reduced pressure and with or without an inert gas:

1) One mole of a C-8 to C-20 alcohol, which can be linear or branched, expressed by the general formula $CH_3$—$[CH_2]_{7-19}$—OH;
2) One mole of a C-12 to C-22 carboxylic acid, which can be linear or branched, expressed by the general formula $CH_3$—$[CH_2]_{11-21}$—COOH; and
3) An esterification catalyst. The amount of esterification catalyst used is specific to the catalyst chosen.

The components are mixed and heated until the acid value, a titration with alkali to a phenolphthalein end point, is below 10, and preferably less than 5.

EXAMPLES

This invention will now be described with reference to the following example processes for producing the ester, which are merely illustrative of this invention.

Example 1

A three-necked flask having a capacity of one liter equipped with a stirrer, a thermometer, a nitrogen gas sparge, and a condenser with a flask for capturing by product water was charged with 130 grams of 2-ethyl hexanol (octanol) (from Eastman Chemical), 282 grams of oleic acid (octadecenoic acid, FA-2 from Arizona Chemical), and 0.8 grams of sulfuric acid. The components were mixed and heated to 150° C. Heating was continued for four hours with a resultant acid value of 7.7. The whole process was carried out in a nitrogen gas atmosphere.

Example 2

A three-necked flask having a capacity of one liter equipped with a stirrer, a thermometer, a nitrogen gas sparge, and a condenser with a flask for capturing by product water was charged with 186 grams of lauryl alcohol (dodecanol) (Alfol 12 supplied by Sasol North America), 282 grams of oleic acid (octadecenoic acid, FA-2 from Arizona Chemical), and 0.95 grams of sulfuric acid. The components were mixed and heated to 150° C. Heating was continued for four hours with a resultant acid value of 4.9. The whole process was carried out in a nitrogen gas atmosphere.

Example 3

A three-necked flask having a capacity of one liter equipped with a stirrer, a thermometer, a nitrogen gas sparge, and a condenser with a flask for capturing by product water was charged with 242 grams of hexadecanol (Alfol 16 from Sasol North America), 282 grams of oleic acid (octadecenoic acid, FA-2 from Arizona Chemical), and 1.0 grams of sulfuric acid. The components were mixed and heated to 150° C.

Heating was continued for four hours with a resultant acid value of 4.7. The whole process was carried out in a nitrogen gas atmosphere.

Example 4

A three-necked flask having a capacity of one liter equipped with a stirrer, a thermometer, a nitrogen gas sparge, and a condenser with a flask for capturing by product water was charged with 186 grams of 2-butyloctanol (Isofol 12 from Sasol North America), 284 grams of stearic acid (octadecanoic acid, Century 1224 from Arizona Chemical), and 0.95 grams of sulfuric acid. The components were mixed and heated to 150° C. Heating was continued for four hours with a resultant acid value of 6.3. The whole process was carried out in a nitrogen gas atmosphere.

Example 5

A three-necked flask having a capacity of one liter equipped with a stirrer, a thermometer, a nitrogen gas sparge, and a condenser with a flask for capturing by product water was charged with 186 grams of lauryl alcohol (dodecanol) (Alfol 12 from Sasol North America), 202 grams of coconut fatty acid (dodecanoic acid, Emery 622 from Cognis-Oleochemicals), and 0.8 grams of sulfuric acid. The components were mixed and heated to 150° C. Heating was continued for four hours with a resultant acid value of 7.7. The whole process was carried out in a nitrogen gas atmosphere.

Example 6

A three-necked flask having a capacity of one liter equipped with a stirrer, a thermometer, a nitrogen gas sparge, and a condenser with a flask for capturing by product water was charged with 200 grams of tridecyl alcohol (from Exxon Chemical), 282 grams of oleic acid (octadecenoic acid, FA-2 from Arizona Chemical), and 1.2 grams of sulfuric acid. The components were mixed and heated to 150° C. Heating was continued for four hours with a resultant acid value of 4.7. The whole process was carried out in a nitrogen gas atmosphere.

Example 7

A three-necked flask having a capacity of one liter equipped with a stirrer, a thermometer, a nitrogen gas sparge, and a condenser with a flask for capturing by product water was charged with 130 grams of 2-ethyl hexanol (octanol, from Eastman Chemical), 202 grams of coconut fatty acid (dodecanoic acid, Emery 622 from Cognis-Oleochemicals), and 0.6 grams of sulfuric acid. The components were mixed and heated to 150° C. Heating was continued for four hours with a resultant acid value of 7.2. The whole process was carried out in a nitrogen gas atmosphere.

Example 8

A three-necked flask having a capacity of one liter equipped with a stirrer, a thermometer, a nitrogen gas sparge, and a condenser with a flask for capturing by product water was charged with 186 grams of 2-butyloctanol (Isofol 12 from Sasol North America), 284 grams of isostearic acid (Jaric I-18IG from Jarchem Industries, Inc.), and 1.0 grams of sulfuric acid. The components were mixed and heated to 150° C. Heating was continued for four hours with a resultant acid value of 6.3. The whole process was carried out in a nitrogen gas atmosphere.

Laboratory Evaluations

Various esters, such as those produced above in accordance with this invention, were used to treat various phosphate ores. In the following examples, which also are merely illustrative of this invention, higher carbon esters were used in the ore floatation processes for several different phosphate ores.

Florida Phosphate Ore, Location A:

The fatty acid floatation agent used was Bastech 365 from Bastech, LLC. The mixed methyl ester used was C-68 from Stepan Corporation. The octyl ester used was the ester described in Example #1. The dodecyl ester used was the ester described in example #2.

The dosage used was 8.5 ml of a 60/40 blend of Bastech 365 fatty acid and 40% ester float aid. The results of using these float aids are shown in Table 1.

TABLE 1

| Float Aid | Concentrate | Tails | % Conc. | % Tails |
|---|---|---|---|---|
| Methyl Ester | 102.5 g | 880.3 g | 10.43% | 89.57% |
| Octyl Ester | 158.3 g | 837.9 g | 15.88% | 84.12% |
| Dodecyl Ester | 166.1 g | 820.2 g | 16.86% | 83.14% |

Note the drastic increase in quantity of ore floated with octyl ester and dodecyl ester versus the methyl ester.

Florida Phosphate Ore, Location B:

Using the same methyl ester, octyl ester, and dodecyl ester as in floatation #1 above, the dosage used was 0.3 ml of a 60/40 blend of Bastech 365 fatty acid and 40% ester float aid. The results of using these float aids are shown in Table 2.

TABLE 2

| Float Aid | Concentrate | Tails | % Conc. | % Tails |
|---|---|---|---|---|
| Methyl Ester | 108.2 g | 872.9 g | 11.02% | 88.98% |
| Octyl Ester | 145.4 g | 832.6 g | 14.87% | 85.13% |
| Dodecyl Ester | 194.4 g | 788.5 g | 19.78% | 80.22% |

In this specific phosphate rock there is a significant quantity increase of ore floated with octyl ester and a second significant quantity increase with dodecyl ester relative to methyl ester.

North Carolina Phosphate Ore:

Using the same methyl ester, octyl ester, and dodecyl ester as in floatation #1 above, the dosage is 6.0 ml of 6% solution of Bastech 382 pre-saponified with soda ash and 210 microliters of float aid added neat. The results of using these float aids are shown in Table 3.

TABLE 3

| Float Aid | Concentrate | Tails | % Conc. | % Tails |
|---|---|---|---|---|
| Methyl Ester | 315.0 g | 644.9 g | 32.82% | 67.18% |
| Octyl Ester | 455.4 g | 511.4 g | 47.10% | 52.90% |
| Dodecyl Ester | 469.9 g | 495.9 g | 48.65% | 51.35% |

Note the drastic increase in quantity or ore floated with octyl ester and dodecyl ester versus the methyl ester.

Florida Phosphate Ore, Location B:

With this ore, testing was conducted using recycled motor oil (R.M. Oil) versus Example #1 and Example #2 with a 60/40 blend of Bastech 365 fatty acid and 40% float aid. The feed $P_2O_5$ percentage is 12.2%. The results of using these float aids are shown in Table 4

TABLE 4

| Dose | Float Aid | Conc. | Tails | % Conc. | % Tails | Conc. $P_2O_5$% | Tails $P_2O_5$% | Recovery |
|---|---|---|---|---|---|---|---|---|
| 0.6 ml | R.M. Oil | 75.7 g | 928.5 g | 7.54 | 92.46 | 67.95 | 7.21 | 43.45% |

TABLE 4-continued

| Dose | Float Aid | Conc. | Tails | % Conc. | % Tails | Conc. $P_2O_5$% | Tails $P_2O_5$% | Recovery |
|---|---|---|---|---|---|---|---|---|
| 0.6 ml | Exam. 1 | 135.5 g | 865.1 g | 13.54 | 86.46 | 69.44 | 2.63 | 80.53% |
| 0.6 ml | Exam. 2 | 101.6 g | 907.8 g | 10.06 | 89.94 | 69.55 | 4.91 | 61.32% |

The recovery is calculated as concentrate grams times concentrate percent $P_2O_5$ divided by concentrate grams times concentrate percent $P_2O_5$ plus tails grams times tails percent $P_2O_5$. As can be seen, the results of Examples #1 and #2 are better than when using recycled motor oil.

North Carolina Phosphate Ore:

Bastech 382 dosage is 6% solution of Bastech 382 pre-saponified with soda ash. Float aid is added neat. The results of using these float aids are shown in Table 5.

TABLE 5

| Test # | 382 Dose | 348 Dose | Conc. Grams | Tails Grams | Total Weight | Conc. % | Tails % | Conc. P2O5 | Conc. CaO | Conc. SiO2 | Tails P2O5 | Recovery |
|---|---|---|---|---|---|---|---|---|---|---|---|---|
| 1 | 5 ml | 150 µl Diesel | 371.80 | 131.20 | 503.00 | 73.92 | 26.08 | 26.22 | 41.18 | 17.30 | 6.06 | 92.46 |
| 2 | 3 ml | 150 µl | 356.90 | 155.70 | 512.60 | 69.63 | 30.37 | 27.18 | 43.39 | 14.14 | 7.81 | 88.86 |
| 3 | 4 ml | 150 µl | 366.60 | 151.30 | 517.90 | 70.79 | 29.21 | 27.26 | 43.58 | 13.05 | 1.86 | 97.26 |
| 4 | 5 ml | 150 µl | 357.80 | 147.70 | 505.50 | 70.78 | 29.22 | 27.18 | 43.39 | 14.14 | 7.81 | 88.86 |
| 5 | 6 ml | 150 µl | 365.90 | 144.30 | 510.20 | 71.72 | 28.28 | 26.62 | 42.62 | 15.01 | 1.25 | 98.18 |
| 6 | 7 ml | 150 µl | 369.70 | 147.20 | 516.90 | 71.52 | 28.48 | 26.61 | 42.75 | 15.49 | 1.49 | 97.82 |
| 7 | 3 ml | 100 µl | 350.40 | 157.50 | 507.90 | 68.99 | 31.01 | 27.30 | 43.15 | 13.49 | 2.46 | 96.11 |
| 8 | 4 ml | 100 µl | 353.50 | 158.60 | 512.10 | 69.03 | 30.97 | 27.31 | 43.34 | 13.99 | 2.62 | 95.87 |
| 9 | 5 ml | 100 µl | 353.70 | 156.60 | 510.30 | 69.31 | 30.69 | 27.31 | 43.46 | 13.68 | 2.12 | 96.68 |
| 10 | 6 ml | 100 µl | 369.00 | 153.50 | 522.50 | 70.62 | 29.38 | 27.12 | 43.29 | 14.24 | 1.88 | 97.20 |
| 11 | 7 ml | 100 µl | 369.70 | 147.20 | 516.90 | 71.52 | 28.48 | 26.61 | 42.75 | 15.49 | 1.49 | 97.82 |
| 12 | 3 ml | 200 µl | 352.90 | 156.20 | 509.10 | 69.32 | 30.68 | 27.33 | 42.57 | 12.32 | 1.95 | 96.94 |
| 13 | 4 ml | 200 µl | 359.00 | 148.80 | 507.80 | 70.70 | 29.30 | 27.16 | 42.91 | 13.60 | 1.50 | 97.76 |
| 14 | 5 ml | 200 µl | 365.30 | 141.90 | 507.20 | 72.02 | 27.98 | 26.67 | 42.29 | 12.85 | 1.49 | 97.88 |
| 15 | 6 ml | 200 µl | 367.20 | 141.90 | 511.60 | 71.77 | 28.23 | 26.89 | 42.51 | 12.64 | 1.40 | 97.99 |
| 16 | 7 ml | 200 µl | 367.30 | 140.10 | 507.40 | 72.39 | 27.61 | 26.78 | 42.86 | 12.19 | 1.21 | 98.31 |
| Feed | | | | | | | | 19.43 | | | | |

Plant Trial:

Full-scale floatation testing was performed at one of the ore treatment plants located in North Carolina. The novel biodegradable ester of the present invention was used in place of the traditional petroleum hydrocarbon. Samples were collected and phosphorous recovery was calculated.

The current prior art primary floatation aid is Bastech 382 fatty acid. The current flotation aid is #2 diesel fuel. The current feed rate is 12 gallons per minute of a 6% solution of saponified Bastech 382 and 0.5 gallons per minute of #2 diesel fuel per circuit. Previous float aid trials that have failed are recycled motor oil, #5 fuel oil, and biodiesel (methyl soyate), using float aids related to, for example, #2 diesel fuel.

The plant trial for the present invention was run using an ester of mixed fatty acids and octanol, specifically 2-Ethyl Hexanol, which is Example #1. The results of using #2 diesel fuel as the float aid are shown in Table 6. The results of substituting the higher carbon esters as called for by the present invention are shown in Table 7 and Table 8.

TABLE 6

| Pre-Trial Data | | | | | |
|---|---|---|---|---|---|
| Date | B-382 | #2 Diesel | $P_2O_5$ Feed | $P_2O_5$ Conc. | Recovery |
| 8/10 | 12 gpm | 0.5 gpm | 17.84% | 27.33% | 88.67% |
| 8/11 A | 12 gpm | 0.5 gpm | 18.14% | 27.27% | 87.51% |

TABLE 6-continued

| Pre-Trial Data | | | | | |
|---|---|---|---|---|---|
| Date | B-382 | #2 Diesel | $P_2O_5$ Feed | $P_2O_5$ Conc. | Recovery |
| 8/11 P | 12 gpm | 0.5 gpm | 19.25% | 27.72% | 87.08% |
| 8/12 A | 12 gpm | 0.5 gpm | 18.29% | 27.10% | 89.18% |
| 8/12 P | 12 gpm | 0.5 gpm | 17.56% | 27.51% | 88.20% |
| 8/13 A | 12 gpm | 0.5 gpm | 19.10% | 27.65% | 89.31% |
| 8/13 P | 12 gpm | 0.5 gpm | 14.24% | 27.40% | 87.99% |
| Average | | | 17.77% | 27.42% | 88.45% |

TABLE 7

| Trial #1 data: | | | | | |
|---|---|---|---|---|---|
| Date | B-382 | Example #1 | $P_2O_5$ Feed | $P_2O_5$ Conc. | Recovery |
| 6/16 A | 10 gpm | 0.4 gpm | 16.87% | 27.53% | 86.39% |
| 8/16 P | 10 gpm | 0.4 gpm | 15.81% | 27.38% | 88.67% |
| 8/17 A | 10 gpm | 0.4 gpm | 16.86% | 26.82% | 87.51% |
| 8/17 P | 10 gpm | 0.4 gpm | 17.29% | 26.88% | 87.08% |
| 8/18 A | 10 gpm | 0.4 gpm | 17.35% | 26.91% | 94.38% |
| Plant outage | | | | | |
| 8/21 A | 10 gpm | 0.4 gpm | 18.39% | 27.26% | 89.95% |
| 8/21 P | 10 gpm | 0.4 gpm | 18.48% | 27.31% | 90.65% |
| Average | | | 17.29% | 27.15% | 89.23% |

Using the float aids of Example #1 in place of #2 diesel fuel allowed a 17% reduction in fatty acid usage and a 20% reduction in float aid dosage. The above reduction in usage of Example #1 makes the present invention economically viable.

TABLE 8

| Trial #2 data: | | | | | |
|---|---|---|---|---|---|
| Date | B-382 | Example #1 | $P_2O_5$ Feed | $P_2O_5$ Conc. | Recovery |
| 9/1 A | 10 gpm | 0.5 gpm | 16.28% | 26.98% | 93.14% |
| 9/1 P | 10 gpm | 0.5 gpm | 17.76% | 26.80% | 95.74% |

TABLE 8-continued

| Trial #2 data: | | | | | |
|---|---|---|---|---|---|
| Date | B-382 | Example #1 | $P_2O_5$ Feed | $P_2O_5$ Conc. | Recovery |
| 9/2 A | 10 gpm | 0.5 gpm | 17.86% | 27.41% | 95.56% |
| 9/2 P | 10 gpm | 0.5 gpm | 17.05% | 27.38% | 94.60% |
| 9/3 A | 10 gpm | 0.5 gpm | 18.08% | 27.78% | 91.13% |
| 9/3 P | 10 gpm | 0.5 gpm | 18.58% | 27.13% | 90.11% |
| 9/4 A | 10 gpm | 0.5 gpm | 17.18% | 27.14% | 93.41% |
| 9/4 P | 10 gpm | 0.5 gpm | 18.02% | 27.77% | 93.50% |
| Average | | | 17.60% | 27.30% | 93.40% |

Running the float aids of Example #1 at a dosage equal to #2 diesel fuel resulted in an increase in recovery of 4.9%, which is extremely significant.

As can be seen, using the biodegradable floatation of the present invention, namely higher order carbon esters, in the froth floatation process for ore beneficiation results in a significant increase in ore recovery. Overall, using an ester of C-8 and above alcohols, and preferably C-8 through C-20 alcohols, and C-2 through C-12 diols or triols, reacted with C-12 through C-22 carboxylic acids or C-2 through C-36 dicarboxylic acids provides these significantly increased results.

BIODEGRADABILITY

A sample of Example #1 was sent to Stevens Ecology, Mosier, Oreg. for a biodegradability determination. Example #1 was tested using the OECD 302D Ultimate Biodegradability Assay and was found to be 85% mineralized to inorganic carbon in 35 days. It was concluded that Example #1 is "Ultimately Biodegradable" according to OECD and EPA definitions The above description sets forth the best mode of the invention as known to the inventor at this time, and is for illustrative purposes only, as it is obvious to one skilled in the art to make modifications to this process without departing from the spirit and scope of the invention and its equivalents as set forth in the appended claims.

What is claimed is:

1. In a method for phosphate ore beneficiation including subjecting said phosphate ore containing at least one of clay and sand to flotation to effect separation of the phosphate mineral from at least one of clay and sand wherein the improvement comprises replacing petroleum based hydrocarbons such that no petroleum based hydrocarbons are present during flotation with a biodegradable, hydrophobic ester formed from an alcohol and a carboxylic acid, optionally branched, wherein the alcohol is selected from C-8 through C-20 alcohols or from C-2 through C-12 diols and the carboxylic acids is selected from C-12 through C-22 carboxylic acids or C-2 through C-36 unsubstituted dicarboxylic acids, optionally branched.

2. The method of claim 1 wherein the flotation is in the presence of a fatty acid floatation agent combined with the biodegradable ester.

3. The method as claimed in claim 1, wherein the carboxylic acid is C-12 through C-22 carboxylic acids and the C-12 through C-22 carboxylic acid is selected from the group consisting of tall oil, coconut oil, corn oil, cottonseed oil, palm oil, rapeseed oil, safflower oil, sunflower oil, soybean oil, lard, tallow, fatty acids derived from these oils, and combinations thereof.

4. The method as claimed in claim 1, wherein the carboxylic acid is C-2 through C-36 dicarboxylic acids and the C2 through C36 dicarboxylic acids are selected from the group consisting of maleic acid, fumaric acid, succinic acid, glutaric acid, adipic acid, oxalic acid, malonic acid, suberic acid, azelaic acid, sebacic acid, phthalic acid and its isomers, dodecanoic acid, thapic acid, traumatic acid, and combinations thereof.

5. The method as claimed in claim 1, wherein the C-8 through C-22 alcohol, optionally branched, is selected from the group consisting of octyl alcohol, decyl alcohol, dodecyl alcohol, myristal alcohol, stearyl alcohol, gadolyl alcohol, erucyl alcohol, and combinations thereof.

6. The method as claimed in claim 5, wherein the alcohols are branched.

7. The method as claimed in claim 1, wherein the diol is selected from the group consisting of ethylene glycol, propylene glycol, butylene glycol, hexylene glycol, and combinations thereof.

* * * * *